US011311760B2

(12) United States Patent
Ryczek et al.

(10) Patent No.: US 11,311,760 B2
(45) **Date of Patent: *Apr. 26, 2022**

(54) ELECTRIC-PNEUMATIC ACTUATOR ASSEMBLY

(71) Applicant: Tyco Fire Products LP, Lansdale, PA (US)

(72) Inventors: Chad L. Ryczek, Oconto Falls, WI (US); Richard J. Biehl, Marinette, WI (US); Brian L. Counts, Menominee, MI (US)

(73) Assignee: Tyco Fire Products LP, Lansdale, PA (US)

( * ) Notice: Subject to any disclaimer, the term of this patent is extended or adjusted under 35 U.S.C. 154(b) by 243 days.

This patent is subject to a terminal disclaimer.

(21) Appl. No.: 16/439,397

(22) Filed: Jun. 12, 2019

(65) Prior Publication Data

US 2019/0358479 A1 Nov. 28, 2019

Related U.S. Application Data

(63) Continuation of application No. 15/300,767, filed as application No. PCT/US2015/023796 on Apr. 1, 2015, now Pat. No. 10,363,447.

(Continued)

(51) Int. Cl.
*A62C 37/46* (2006.01)
*A62C 3/07* (2006.01)

(Continued)

(52) U.S. Cl.
CPC ..... *A62C 37/46* (2013.01); *A62C 3/07* (2013.01); *A62C 35/023* (2013.01); *A62C 35/11* (2013.01)

(58) Field of Classification Search
CPC ..... A62C 3/07; A62C 35/023; A62C 35/11; A62C 37/04; A62C 37/36; A62C 37/38; A62C 37/40; A62C 37/44; A62C 37/46

(Continued)

(56) References Cited

U.S. PATENT DOCUMENTS 1,933,694 A * 11/1933 Allen ..... A62C 35/605 60/39.47
4,282,931 A * 8/1981 Golben ..... A62C 37/36 169/26

(Continued)

FOREIGN PATENT DOCUMENTS

| | | |
|---|---|---|
| CN | 203329236 U | 12/2013 |
| SU | 1192837 | 11/1985 |
| WO | WO-2014/047579 A1 | 3/2014 |

OTHER PUBLICATIONS

U.S. Appl. No. 61/974,286, filed Apr. 2, 2014, 122 pages.

(Continued)

*Primary Examiner* — Cody J Lieuwen
(74) *Attorney, Agent, or Firm* — Foley & Lardner LLP

(57) ABSTRACT

An actuator assembly for use in fire suppression systems for use in vehicle and industrial fire protection systems. The actuator assembly engages a cartridge of pressurized gas and releases the gas contained therein with a puncturing assembly. The actuator assembly includes a receptacle that controls the manner in which the actuator assembly and cartridge engage one another. The actuator assembly is configured for electrical and pneumatic actuation for rupturing the seal of the cartridge of pressurized gas. The actuator assembly has a housing that includes at least one inlet port that is coupled to a pressurized gas source, which is formed between a first chamber for electrical components sealed from the operative environment of the actuator assembly and a second chambers for the puncturing assem- (Continued)

bly. The actuator assembly allows for serial interconnection of multiple actuator assemblies for operation by a single source of pressurized gas.

20 Claims, 5 Drawing Sheets

Related U.S. Application Data

(60) Provisional application No. 61/974,286, filed on Apr. 2, 2014.

(51) Int. Cl.
*A62C 35/02* (2006.01)
*A62C 35/11* (2006.01)

(58) Field of Classification Search
USPC ..... 169/9, 61, 62
See application file for complete search history.

(56) References Cited

U.S. PATENT DOCUMENTS 4,377,209 A 3/1983 Golben
4,970,936 A 11/1990 Denker et al.
5,255,634 A 10/1993 Mansour
6,164,383 A * 12/2000 Thomas ..... A62C 3/07 169/26
8,640,783 B2 * 2/2014 Dahlgren ..... A62C 35/68 169/61
2003/0222235 A1 12/2003 Filkovski et al.
2005/0072463 A1 4/2005 Sundholm et al.
2005/0269111 A1 * 12/2005 McLane, Jr. ..... A62C 3/07 169/85
2013/0032741 A1 * 2/2013 Porterfield, Jr. ..... A62C 3/07 251/129.15
2013/0269784 A1 * 10/2013 Dahlgren ..... A62C 37/50 137/1
2014/0166913 A1 * 6/2014 Phillips ..... A62C 13/76 251/89
2016/0356395 A1 12/2016 Rogala et al.

OTHER PUBLICATIONS

International Search Report and Written Opinion for International Application No. PCT/US2015/023796, dated Nov. 16, 2015, 20 pages.

* cited by examiner

ELECTRIC-PNEUMATIC ACTUATOR ASSEMBLY

CROSS-REFERENCE TO RELATED PATENT APPLICATIONS

This application is a continuation of U.S. application Ser. No. 15/300,767, filed Sep. 29, 2016, which is a national phase application of International Application No. PCT/US2015/023796, filed Apr. 1, 2015, which claims the benefit of priority to U.S. Provisional Application No. 61/974,286, filed Apr. 2, 2014, each of which is incorporated herein by reference in its entirety.

BACKGROUND

The present invention is directed to fire suppression systems for vehicles and industrial applications. More specifically, the present invention is directed to actuators for use in fire suppression systems for vehicles and industrial applications.

Known fire firefighting systems for vehicles and industrial applications include a fire fighting agent supply coupled to one or more fixed nozzles to protect a hazard or area in which an ignition source and fuel or flammable materials may be found. The firefighting agent supply preferably includes one or more storage tanks or cylinders containing the firefighting agent, such as for example a chemical agent. Each storage tank cylinder includes a pressurized cylinder assembly configured for pressurizing the storage tanks for delivery of the agent under an operating pressure to the nozzles to address a fire in the hazard. The pressurized cylinder assembly includes an actuating or rupturing device or assembly which punctures a rupture disc of a pressurized cylinder containing a pressurized gas, such as for example nitrogen, to pressurize the storage tank for delivery of the firefighting agent under pressure.

In order to operate the rupturing device, the system provides for automatic actuation and manual operation of the rupturing device to provide for respective automated and manual delivery of the chemical agent in response to a fire for protection of the hazard. The rupturing device includes a puncturing pin or member that is driven into the rupture disc of the pressurized cylinder for release of the pressurized gas. The puncturing pin of the rupturing device may be driven electrically or pneumatically to puncture the rupture disc of the pressurized cylinder. A preferred device for driving the puncturing pin is a protracting actuation device (PAD), which includes an electrically coupled rod or member that is disposed above the puncturing pin. When an electrical signal is delivered to the PAD, the rod of the PAD is driven into the puncturing pin which punctures the rupture disc of the pressurized cylinder. In pneumatic manual operation of the rupturing device, pressurized gas from a separate source is delivered to the rupturing device to act on the puncturing pin and drive it into the rupture disc.

One problem with the configuration of prior rupturing assemblies is that the electrical operating components or connectors are exposed either to the harsh environment in which the fire protection system operates or to the pressurized gas which pneumatically operates the assembly. These configurations can increase the maintenance requirements of the system. Moreover, the configuration of the existing rupturing assemblies can cause pressure losses across the device, which can prohibit operation of multiple devices connected serially with a single source of pressurized gas for pneumatic actuation.

Another problem with existing rupturing assemblies is that the puncturing pin can present a hazard when connecting the device to or removing the device from a pressurizing cylinder. More specifically, if the puncturing pin is extended to its actuated position, the pin can cause injury to personnel and the pressurizing cylinder, which can result in accidental discharge of the pressurizing gas.

Accordingly, it would be desirable to have a rupturing assembly that addresses the known difficulties of existing systems, and provides for both electrical and pneumatic actuation, electrical components sealed from the operative environment, serial interconnection with other rupturing assemblies for operation by a single source of pressurized gas, and a configuration that facilitates safe handling and installation of the rupturing assembly.

SUMMARY

The present invention is directed to rupturing assemblies for use in a fire suppression system for vehicles and industrial applications. A preferred embodiment of the rupturing assembly of the present invention is an actuator assembly configured for electrical and pneumatic actuation for rupturing a seal of a cartridge of pressurized gas. The preferred assembly includes a housing having a proximal end and a distal end with a passageway extending axially from the proximal end to the distal end along an actuator axis. The passageway preferably defines a first chamber and a second chamber with the second chamber disposed distally of the first chamber. The housing preferably includes at least one inlet port formed between the first and second chambers in communication with the passageway for coupling to a pressurized gas source. An electrically operated protracting actuation device having an electrical connector and a rod member is preferably disposed within the housing such that the electrical connector is disposed in the first chamber and the rod member is disposed in the second chamber with the first chamber being sealed from the second chamber and the inlet port. A puncturing assembly including a head with a puncturing pin has an actuated position and a retracted position within the passageway with the head in the second chamber. The puncturing assembly translates from the retracted position to the actuated position upon either electrical operation of the protracting actuation device or the pressurized gas delivered to the at least one inlet acting on the head.

In another preferred embodiment of an actuator assembly, the assembly includes an electric component; a puncturing assembly; and a housing having a proximal end and a distal end with a passageway extending axially from the proximal end to the distal end to define an actuator axis. The passageway defines a pneumatic chamber for pneumatically displacing the puncturing assembly within the pneumatic chamber; and an electric component chamber sealed from the pneumatic chamber for housing an electrically operated component that axially displaces the puncturing assembly within the pneumatic chamber. The electric component chamber is preferably sealed against moisture and dust to define an IEC rating of IP67 under the International Electrotechnical Commission (IEC) Standard 60529 (2013 ed. 2.2).

Preferred embodiments of the actuator assembly control the manner in which the assembly engages a cartridge of pressurized gas. The preferred assembly includes a puncturing assembly and a housing having a proximal portion with the puncturing assembly disposed within the passageway for axial displacement from a retracted position. The distal portion of the housing includes a receptacle for preferably axially receiving the sealed cartridge such that axial displacement of the puncturing assembly from the retracted position ruptures the sealed cartridge. A bracket is preferably engaged with the housing that defines a guide path having a first transverse portion and second axial portion to control engagement between the cartridge and the distal portion of the housing. In one preferred aspect, the guide path provides that, when the puncturing assembly is in the retracted position, the cartridge can be axially aligned with the receptacle so that the cartridge is engaged with the housing and, when the puncturing assembly has been axially displaced from the retracted position, the puncturing assembly prevents alignment of the cartridge with the receptacle, and thus prevents engagement of the cartridge with the housing. In another preferred aspect, the guide path provides that, when the puncturing assembly is in the retracted position, the discharged cartridge can be axially disengaged and offset from the receptacle so that the cartridge can be disengaged from the housing; and when the puncturing assembly has been axially displaced from the retracted position, the puncturing assembly prevents disengagement of the cartridge from the receptacle and the housing.

The preferred actuator assemblies provide for preferred fire protection systems in which the preferred actuator assemblies are coupled to an electrical actuation signal source; a plurality of pressurized gas cartridges; and a plurality of storage tanks of firefighting suppressant. In another embodiment of the preferred system, a plurality of the preferred actuator assemblies are interconnected in a chain with a pressurized gas supply coupled to a first actuating device to deliver pressurized gas to the first actuator assembly and a last actuator assembly in the chain so as to provide operation of the plurality of actuators of the assemblies with a one second maximum time interval between the first actuator assembly and the last actuator assembly. Preferably, the plurality of actuator assemblies comprises up to ten actuator assemblies and the connection tubing comprises a total length of up to 150 feet of ¼ inch pneumatic tubing.

While the Summary describes preferred embodiments of an actuator assembly for use in fire suppression systems that overcome difficulties of known rupturing assemblies and associated fire protection systems, including but not limited to, providing for electrical and pneumatic actuation with electrical components that are sealed from the operative environment of the actuator assembly, serial interconnection of multiple actuator assemblies for operation by a single source of pressurized gas, and a configuration that facilitates safe handling and installation of the actuator assembly, the Summary is provided as a general introduction to some embodiments of the invention, and is not intended to be limiting to any particular configuration or system. It is to be understood that various features and configurations of features can be combined in any suitable way to form any number of embodiments of the invention. Some additional example embodiments including variations and alternative configurations are provided herein.

BRIEF DESCRIPTION OF THE DRAWINGS

The accompanying drawings, which are incorporated herein and constitute part of this specification, illustrate exemplary embodiments of the invention and, together with the general description given above and the detailed description given below, serve to explain the features of the exemplary embodiments of the invention.

DETAILED DESCRIPTION

Figure 1:
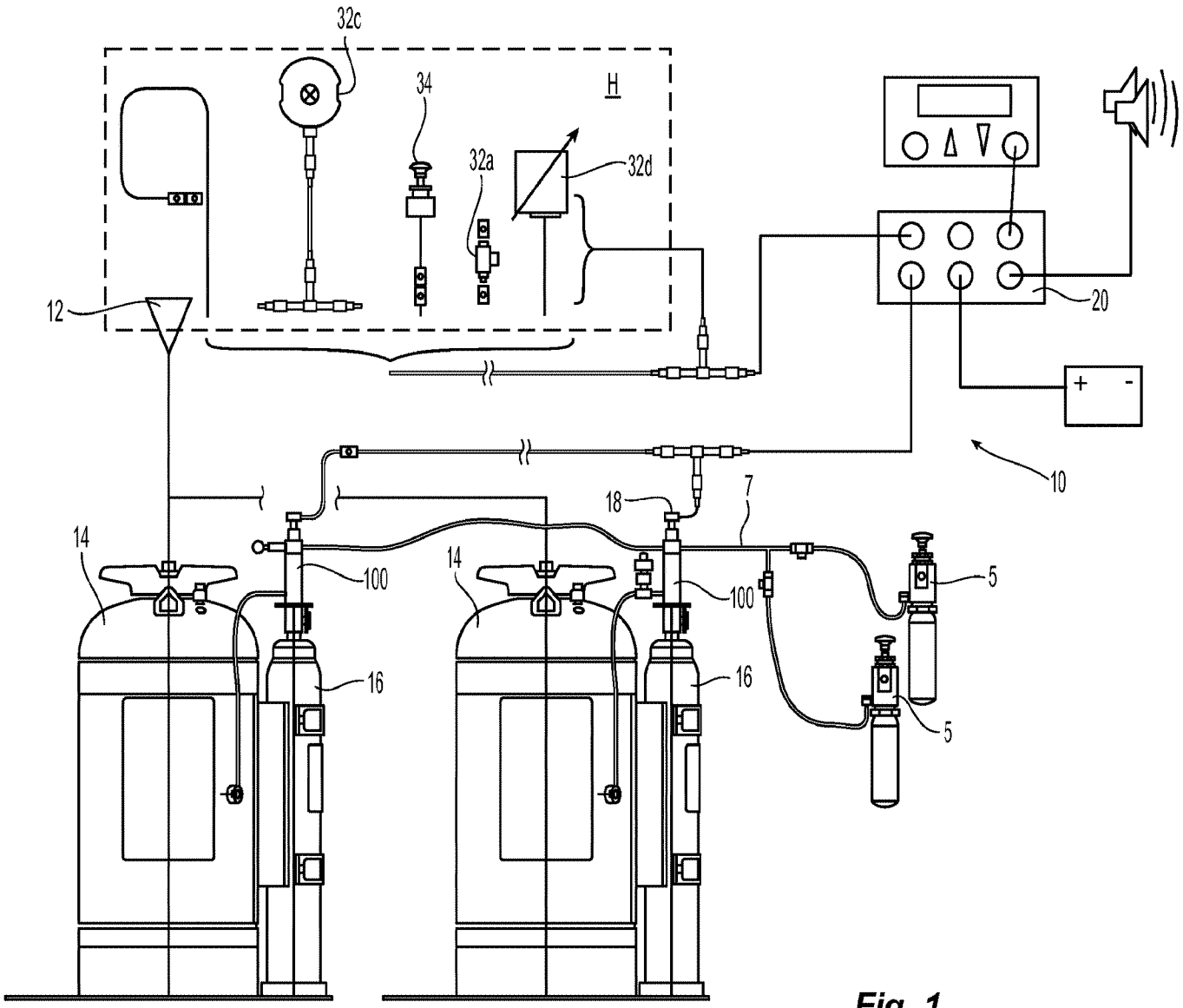
FIG. 1 is a schematic illustration of one embodiment of a fire suppression system.

FIG. 1 is a schematic illustration of a first embodiment of a suppression system 10 that includes a fire fighting agent supply coupled to a preferably fixed nozzle 12 to protect a hazard H or area in which an ignition source and fuel or flammable materials may be found. As shown, the firefighting agent supply preferably includes one or more storage tanks or cylinders 14 containing the firefighting agent, such as for example a chemical agent. Each storage tank 14 preferably includes a sealed cylinder or cartridge 16 containing a pressurized gas, such as for example nitrogen, for pressurizing the tanks 14 in order to deliver the agent under an operating pressure to the nozzle 12 to address a fire in the hazard H. The system 10 can include a centralized controller 20 for automated and manual operation and monitoring of the system 10. The system 10 can further include one or more remote manual operating stations 5 to manually actuate the system. The system can also include one or more detection and manual actuating devices 32*a*-32*d*, 34 to define a detecting circuit of the system 10 for either an automatic or manual detection of a fire event in the area H. Additional features of exemplary firefighting systems for use in combination with the preferred actuation assemblies are shown and described in International PCT Patent Application Publication No. WO2014/047579, which is incorporated by reference in its entirety.

Coupled to the pressurized cartridge 16 is a preferred actuator assembly 100 which punctures the sealed cartridge 16 to release the pressurized gas contained therein. The preferred actuator assembly 100 is connected or piped to the storage tank 14 to convey the released pressurized gas and pressurize the storage tanks 14 for delivery of the firefighting agent under pressure to the one or more nozzles 12. The preferred actuator assembly 100 is structured to provide selective electrical and/or pneumatic actuation for puncturing the rupture disc of the sealed pressurized cartridge 16.

Figure 2A:
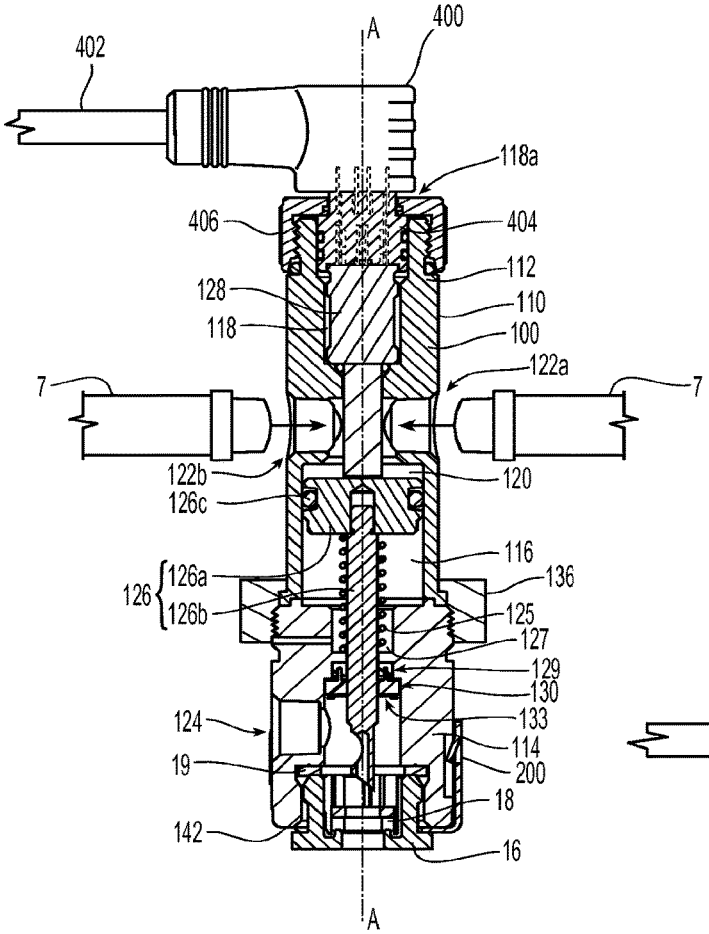
FIG. 2A is a partial cross-sectional view of a preferred actuator assembly in an unactuated state for use in the system of FIG. 1.
Figure 2B:
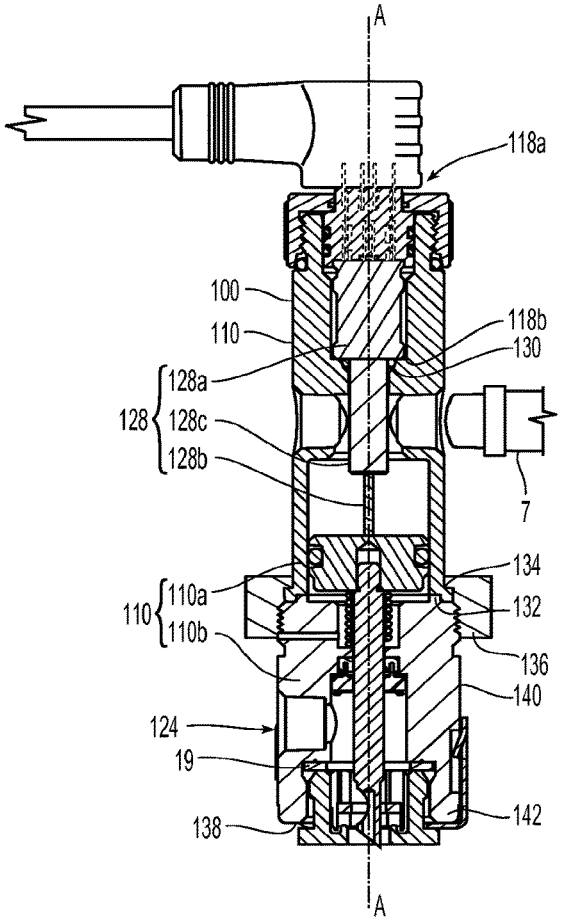
FIG. 2B is a partial cross-sectional view of a preferred actuator assembly in an actuated state for use in the system of FIG. 1.

Referring to FIGS. 2A and 2B, an installed preferred rupturing or actuator assembly 100 is shown respectively in its unactuated and actuated states. The preferred actuator assembly 100 includes an internal puncturing assembly that is driven pneumatically or electrically into the rupture disc or seal of a pressurized cartridge 16 for release of the pressurized gas. The preferred actuator assembly includes a housing 110 having a proximal portion 112 and a distal portion 114 with an internal surface defining an internal passageway 116 extending axially from the proximal portion to the distal portion along an actuator axis A-A. The passageway 116 preferably defines a first chamber 118 and a second chamber 120 with the second chamber 120 disposed preferably distally of the first chamber 118. The first and second chambers 118, 120 are preferably centered and axially aligned along the actuator axis A-A. The housing 110 preferably includes at least one pneumatic port and more preferably includes two pneumatic ports 122*a*, 122*b* in communication with the passageway 116 and formed between the first and second chambers 118, 120 to provide an inlet and/or outlet port for coupling to a pressurized gas source using appropriate tubing 7 and/or interconnecting with another actuating assembly. More preferably, the pneumatic ports 122*a*, 122*b* are two inlet ports diametrically disposed about the passageway to define an internal conduit that intersects the passageway 116. The housing 110 further preferably includes an outlet port 124 for preferably connecting and conveying the pressurized gas released from cartridge 16 to a storage tank 14 of firefighting agent.

Disposed within the passageway 116 is a preferred puncturing assembly 126 that includes an enlarged head 126*a* and a puncture pin 126*b* engaged with the head 126*a*. Upon actuation, the puncture assembly 126 is axially and distally displaced along the passageway 116 so that the puncture pin 126*b* penetrates and ruptures the seal or rupture disc 18 of the pressurized gas cartridge 16 coupled to the distal portion 114 of the actuator assembly housing 110. The head 126*a* is preferably housed in the second chamber 120 and sized to define a surface upon which a pneumatic pressure can act to displace the actuating assembly 126. Accordingly, the second chamber 120 is preferably configured as a pneumatic chamber 120 for pneumatic actuation and displacement of the puncturing assembly 126. The preferred pneumatic chamber 120 is placed in fluid communication with the pneumatic ports 122*a*, 122*b* and pressurized by the pressurized gas delivered to the inlet ports 122*a*, 122*b*. The gas pressure within the chamber 120 acts on the upper or proximal surface of the enlarged head 126*a* to axially displace the puncturing assembly 126 and its puncturing pin 126*b*. To facilitate the pneumatic actuation, the pneumatic chamber 120 is dimensioned to form a fluid tight seal with the enlarged head 126*a* of the puncturing assembly. The enlarged head can include a peripheral gasket 126*c* to form a fluid tight and sliding engagement with the internal surface of the housing defining the pneumatic chamber 120.

The puncturing assembly 126 has a preferred retracted position in which the assembly 126 is biased in the proximal direction within the pneumatic chamber 120. The actuator assembly 100 preferably includes a spring member 125 to proximally bias the puncturing assembly 126 within the pneumatic chamber 120. The preferred spring member 125 can be a compression spring centered about the puncturing pin 126*b* abutting the enlarged head 126*a* of the puncturing assembly. The compression spring member 125 is preferably seated within a seat 127 formed along a portion of the pneumatic chamber 120 such that the uncompressed state of the spring 125 biases the puncturing assembly 126 proximally to its retracted position within the passageway 116. More preferably, the uncompressed state of the spring member 125 biases the enlarged head 126*a* to the retracted position distal of the inlet ports 122*a*, 122*b*. Upon pneumatic actuation of the actuator assembly 100, the gas pressure within the pneumatic chamber 120 acts on the enlarged head 126*a* to compress the spring member 125 and locate the puncturing assembly in its displaced actuated position within the passageway 116. The head 126*a* and pneumatic chamber 120 are appropriately sized and dimensioned to define a preferred operation pressure sufficient to fully displace the puncturing assembly 126. For example, the head 126*a* and pneumatic chamber 120 can be sized and dimensioned to define an operating pressure of about 100 pounds per square inch (psi.). The operating pressure can range to be greater or smaller than 100 so long as it is sufficient to displace the puncturing assembly 126. Moreover, the desired operating pressure can vary or range up to a preferred maximum of about 300 psi, and more preferably to a maximum of less than 300 psi. and even more preferably up to a maximum of 265 psi.

In addition to its pneumatic operation, the actuator assembly 100 provides for electrical actuation to axially displace the puncturing assembly 126. Further preferably disposed in the passageway 116 of the housing 110 is an electrically operated device or component for displacing the puncturing assembly 126. More preferably, disposed in the passageway 116 is an electrically operated protracting actuation device (PAD) 128 for driving the puncturing assembly 126 into the rupture disc. The PAD 128 generally includes a proximal electrical connector 128*a* for receiving an electric actuation signal. Extending distally from the electrical connector 128*a* is a rod member 128*b*. The rod member 128*b* is electrically coupled to the electrical connector 128*a* so that, when the connector 128*a* receives an appropriate electric actuating signal, the rod member 128*b* is axially displaced from a retracted position or configuration within a sheath 128*c*. The displaced rod member 128*b* acts against the enlarged head 126*a* and the bias of the preferred compression spring member 125 to drive and axially displace the puncturing assembly 126 from its retracted position to its actuated position as shown in FIG. 2B.

The preferred PAD 128 is preferably positioned in the passageway 116 such that the electrical connector 128*a* is completely housed within the first chamber with the rod member 128*b* and the outer sheath 128*c* extending distally toward the second chamber 120. Accordingly in one preferred embodiment, the first chamber 118 is preferably configured as a housing or enclosure for an electric component. Given the vehicle and industrial applications of the preferred actuator assembly, it is anticipated that the actuator assembly is to be exposed to a harsh environment of moisture, fluids, dirt, dust, noise and vibration. The first chamber 118 is thus preferably configured as an electric component chamber or enclosure that is sealed against moisture, liquid and/or dust for housing the electrical connector of the preferred internal PAD 128. More preferably, the electric component chamber 118 is configured to provide a fluid tight seal from the preferred pneumatic chamber 120 and the inlet ports 122*a*, 122*b*. For the preferred embodiments, the electric component chamber is preferably water and dust tight so as to satisfy one or more electric industry standards for electrical enclosures. More particularly, the actuator assembly 100 is configured so as to satisfy one or more codes under the International Electrotechnical Commission (IEC) Standard 60529 (2013 ed. 2.2), which characterizes the ability of an electrical enclosure to protect against entry or ingress by, for example, moisture, dust or dirt. In one preferred aspect, the electric component chamber 118 satisfies the IEC Standard to provide for an IP67 rating, which means that the chamber is protected against dust and the effects of immersion between 15 cm and one meter. The assembly can be further preferably configured to satisfy other industry accepted standards for protection against noise, vibration, and/or shock. By providing the preferred sealing of the electric component chamber 118 and the electric component(s) contained therein, the actuator assembly 100 is believed to be more robust or stable when operated electrically.

The proximal portion 112 of the housing 110 preferably defines an inlet 118*a* in communication with the electric component chamber 118 and through which the PAD 128 is inserted. Axially spaced and formed distally of the inlet 118*a* is a floor 118*b* upon which the electrical connector 128*a* of the PAD 128 sits. Further preferably formed along the floor 118*b* is a seat for seating a sealing member 130. The sealing member 130 preferably circumscribes an axially aligned outlet 118*c* of the electric component chamber 118. Upon insertion of the PAD 128 into the electric component chamber 118, the rod member 128*b* and outer sheath 128*c* preferably extend axially through the outlet 118*c* of the electric component chamber 118 and into the pneumatic chamber 120. Accordingly, the preferred sealing member 130 is an annular gasket disposed about the sheath 128*c* of the PAD 128 and engaged with the electrical connector 128*a*. With the PAD and its electrical connector 128*a* axially secured in the electric component chamber 118, the electrical connector 128*a* compresses the sealing member 130 in its seat to seal the electric component chamber 118 from the distally disposed inlet ports 122*a*, 122*b* and pneumatic chamber 120.

The actuator assembly 100 is shown in FIGS. 2A and 2B electrically connected to a preferred terminal connector 400 to provide an electrical actuating signal to the preferred actuator assembly 100. The terminal connector 400 preferably includes a cable 402 having two wires or conductors for carrying an electric actuating signal from a signal source, such as for example, a central controller 20 of a fire suppression system 10. The terminal connector 400 preferably includes an over mold to provide for an electrical plug connection to facilitate easy removal and plug connection to the internal PAD. Accordingly, the internal wires preferably extend into a plug 404 which forms an electrical coupled connection with the proximal end connector 128*a*. The plug 404 preferably includes two receptacles for receiving two prong wires or contacts extending proximally from the PAD connector 128*a* so as to place the conductors of the terminal connector 400 in contact with the wires of the PAD 128 to energize the PAD 128 and electrically actuate the actuator assembly 100. Alternatively, the electrical connector 128*a* of the PAD 128 can be configured as the receiver for receiving the contacts extending proximally from the plug 404 so long as the internal wires are in sufficient contact to electrically couple the components.

In order to provide the preferably sealed electric component chamber 118 when electrically connected to the terminal connector 400, the inlet 118*a* at the proximal end of the housing 110 defines a preferred inlet diameter for receiving the plug 404 to form an appropriate fluid/dust tight seal. In the illustrative embodiment of FIGS. 2A and 2B, the plug 404 can include one or more O-rings or other sealing members disposed about its periphery to form the preferred seal with the internal surface of the inlet 118*a*. The proximal portion 112 of the housing 110 also preferably includes an external thread for engaging a threaded nut or cap 406 for securing the terminal connector 400 to the actuator assembly 100. With the use of the external nut 406, the terminal connector 400 and its cable 402 can be swiveled in a desired orientation about the actuator axis A-A and then the assembly can be secured in the desired orientation by tightening of the threaded cap 406. Moreover, the preferred threaded nut 406 facilitates the formation of the desired seal about the electric component chamber 118. In particular, the threaded nut 406 forms a preferred secured axial position along the external thread to axially drive the plug 404 against the electrical connector 128*a* of the PAD 128 such that the electrical connector 128*a* compresses the sealing member 130 to form and/or maintain the desired seal between the electric component chamber 118 and the inlet ports 122*a*, 122*b* and the pneumatic chamber 120. The external thread of the proximal portion 112 of the housing can also accommodate a correspondingly threaded cap which can completely cover the inlet 118*a* to seal and protect the chamber 120 when the actuator assembly 100 is installed without an electric connection or during shipment and storage.

By sealing the electric component chamber 118 from the pneumatics and their operation, the actuator assembly 100 can more efficiently use the delivered pressurized gas to operate and displace the puncturing assembly 126. More specifically because the electric component chamber 118 is sealed, the pressurized gas delivered to the inlet ports 122*a*, 122*b* is completely delivered to the pneumatic chamber without any significant loss in pressure or flow from the inlet ports 122*a*, 122*b*. The low or minimal loss in pressure or flow across the preferred actuator assembly 100 can facilitate its interconnection in a preferred daisy-chain or linear connection.

Referring again to the illustrative system 10 of FIG. 1, one or more remote manual operating stations 5 can be provided to manually actuate the system by rupturing a canister of pressurized gas, for example, nitrogen at 1800 psi., to fill and pressurize an actuation line connected to one or more actuation assemblies for pneumatic operation at a desired operating pressure. Manual actuation of multiple rupturing or actuating assemblies may be subject to industry standards and in particular ANSI/UL 1254, Section 42 Pneumatic Operation Test, which provides: 42.1 A valve or other component intended to be pneumatically operated by a master valve or other pneumatic means shall operate as intended after being tested as specified in 42.2. A primary means of actuation that is intended to discharge multiple cylinder/valve assemblies shall result in the operation of all the connected cylinder/valve assemblies to occur within a 1 second maximum time interval between operation of the first cylinder/valve assembly and the last cylinder/valve assembly 42.2. A master valve and cylinder or remote actuator are to be filled and pressurized to their operating pressure at 70° F. (21° C.) and then conditioned at their minimum operating temperature for at least 16 hours. The maximum number of valves or other devices, and the maximum amount and size of tubing or piping intended to be operated by the master valve or remote actuator are then to be installed and pressurized (when applicable) to the operating pressure that corresponds to the pressure at the maximum operating temperature. The system then is to be discharged.

Figure 3:
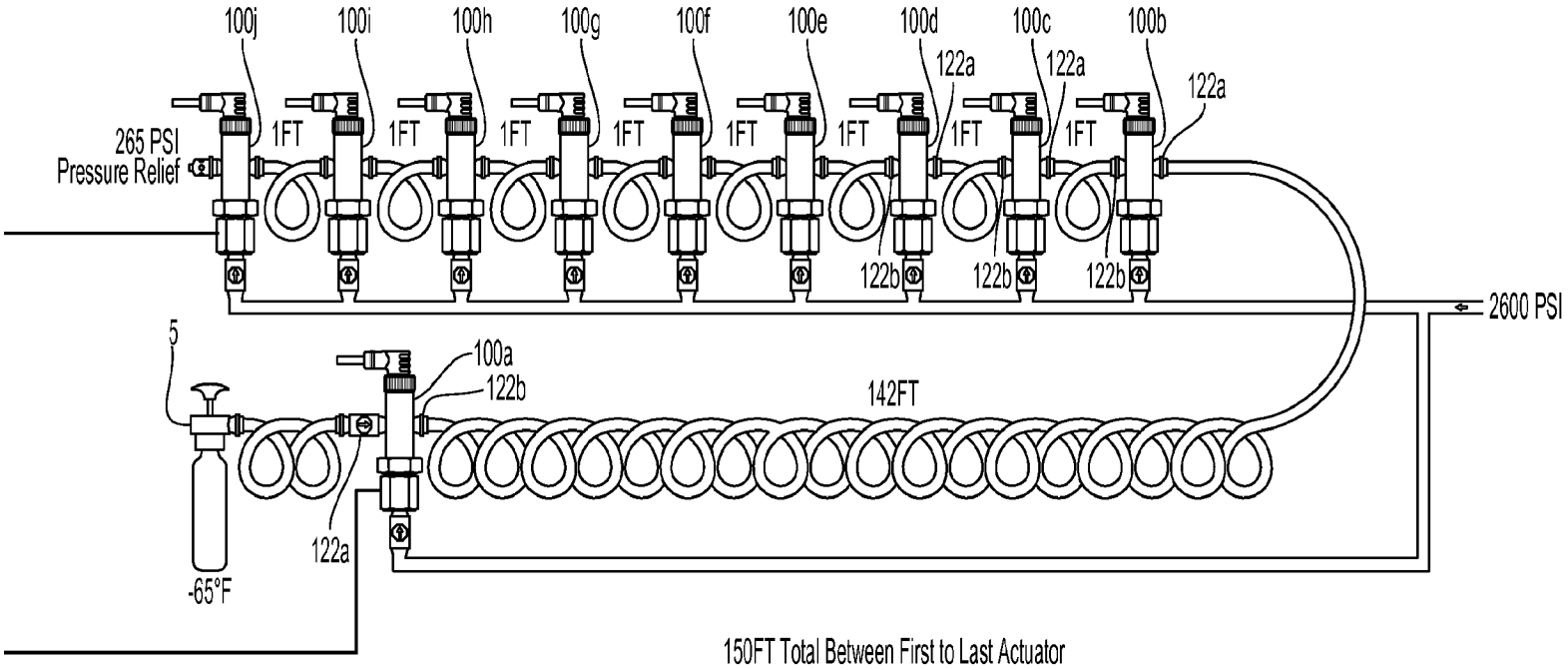
FIG. 3 is a schematic illustration of interconnected assembly of a plurality of preferred actuator assemblies.

In one preferred embodiment of a system incorporating the preferred actuator assembly 100, the system preferably includes up to ten actuation assemblies 100. Illustrated in FIG. 3 is an exemplary test set up for verifying the ability of ten interconnected actuation assemblies 100*a*-100*j*, to satisfy the requirements under Section 42 of the UL Standard. According to the test set up, ten actuation assemblies 100*a*-100*j* were interconnected at their inlet ports 122*a*, 122*b* by connection with tubing having a total length of up to 150 feet of ¼ inch pneumatic tubing. Under the test set up, the preferred actuation assemblies satisfied the pneumatic test requirements of UL1254, Section 42. Accordingly, preferred embodiments of the actuator assembly 100 can provide for a linear spacing of up to 150 ft. between the first and the last actuator assembly.

To facilitate assembly and installation of the actuator assembly 100 itself, the preferred embodiments of the housing 110 preferably include a first housing portion 110*a* and a second housing portion 110*b* that are connected to one another in a desired orientation about the actuation axis A-A to define the preferred passageway described herein. The first housing portion 110*a* is preferably unitary or integrally formed having the proximal portion 112 of the housing including the first preferred sealed electric component chamber 118 and pneumatic ports 122*a*, 122*b*. The second housing portion 110*b* is a separate preferably unitary or integrally formed housing to provide the distal portion 114 of the housing including the discharge port 124. The second housing portion 110*b* preferably includes a proximal portion for engaging a distal portion of the first housing portion 110*a*. The proximal portion of the second housing portion 110*b* preferably defines an annular projection 132 and the distal portion of the first housing portion 110*a* preferably defines an annular seat 134 for receiving the annular projection to selectively orient the first housing portion 110*a* with respect to the second housing portion 110*b* about the actuator axis A-A. A securing nut 136 is preferably disposed about each of the first and second housing portions 110*a*, 110*b* to secure the first housing portion 110*a* to the second housing portion 110*b* once the housing portions are brought together in their desired relative orientation. Additionally or in the alternative, the first housing portion can define the projection and the second housing portion can define the seat of any geometry provided that the engagement of the housing portions 110*a*, 110*b* provides for the desired connection and relative orientation to form the assembly 100.

In the preferred embodiment of the assembly, the preferred second pneumatic chamber 120 is defined by the connection between the first and second housing portions 110*a*, 110*b*. For example, the first housing portion 110*a* can define the proximal portion of the pneumatic chamber to permit insertion and installation of the puncturing assembly 126 therein. The second housing portion 110*b* can define the distal portion of the pneumatic chamber 120 including the preferred seat 127 for the spring member 125 and the outlet of the pneumatic chamber circumscribed by the seat 127 through which the puncturing pin 126*b* extends. The passageway 116 defined by the second housing portion can be formed or configured to house other elements to either center or act as a bearing surface to the axially displaced puncturing pin 126*b*. For example, to center and seal about the puncturing pin 126*b*, the preferred assembly can include a sealing O-ring and more preferably an O-ring U-cup 129, a retaining ring 133 with a pipe plug 131 sandwiched in between and disposed about the puncturing pin 126*b* within the passageway 116. In addition, the second housing portion 110*b* preferably defines a receptacle 138 for axially receiving and securing the sealed fire suppressant cartridge 16. The proximal portion of the receptacle 138 preferably seats a gasket member and more preferably seats a flat gasket ring 19. The receptacle 138 is preferably configured with an internal female thread for engaging a corresponding male thread on the cartridge 16 and bringing the end of the cartridge into contact against and more preferably compress the flat gasket 19. The thread of the receptacle 138 is preferably configured to locate the cartridge 16 at a depth within the receptacle such that axial displacement of the puncturing assembly 126 from the retracted position ruptures the sealed cartridge. The second housing portion 110*b* includes an outer surface 140 of the housing to define a preferred peripheral geometry that is disposed about the passageway 116 and extend parallel to the actuator axis A-A. The outer peripheral surface 140 preferably includes one or more flat or planar surfaces and more preferably defines a hexagonal peripheral geometry about the actuator axis. The second housing portion 110*b* also defines a distal end surface 142 of the actuator assembly 100 that is disposed perpendicular to the actuator axis and surrounds the entrance to the receptacle 138.

In preferred embodiments of the actuator assembly 100, the PAD 128 and its rod member 128*b* remain protracted following electrical actuation and therefore maintain the puncturing assembly 126 in its distally displaced actuated position. Generally, it is desirable to return the puncturing assembly 126 to its initial or retracted position before disconnecting the actuator assembly 100 from an expended cartridge 16 and connecting it to a new pressurized gas cartridge 16. For the preferred assembly 100, the PAD 128 is preferably configured for single use and is to be replaced after an electrical operation in order to return the puncturing assembly 126 to its retracted position. Once the used or actuated PAD 128 is removed, the preferred spring element 125 biases the puncturing assembly 126 to its retracted position. By limiting a preferred removal and installation of a cartridge 16 to require that the puncturing assembly 126 is in its retracted position, the safety of the actuator assembly 100 is enhanced.

In a separate aspect of a preferred actuator assembly, a control element is provided to prevent attachment of a sealed pressurized cartridge to the actuator assembly when the puncturing assembly 126 is in its actuated, axially displaced position. Moreover, the preferred control element is configured to prevent removal of a spent or discharged cartridge before the puncturing assembly 126 is returned to its retracted position. Accordingly, the preferred control element described herein is configured to control the manner in which a pressurized cartridge is coupled to or decoupled from an actuating device. Although the preferred control element is shown and described with respect to the preferred embodiments of an actuator assembly 100 described herein, it should be understood that the control element and its operation is applicable to other actuation assemblies including previously known actuation assemblies in which it is desired to control or limit the manner in which a pressurized or other energized source is coupled to an actuating device. Moreover, the preferred control element is shown and described with respect to a fire system protection application; however, it should be understood that the control element can be used in other applications such as, for example, in the chemical or food processing industries.

Figure 4A:
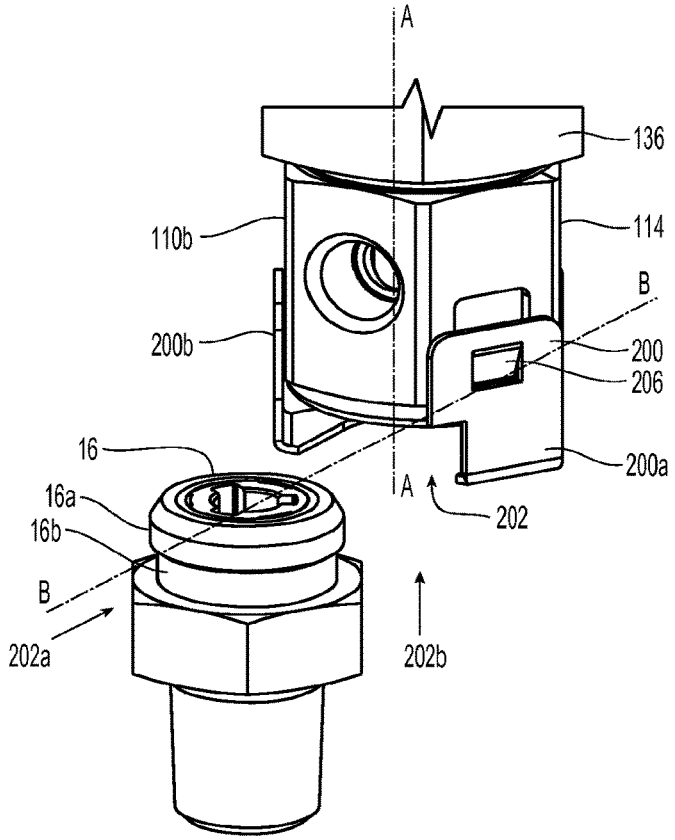
FIG. 4A is a partial perspective exploded view of a cartridge and the actuator assembly of FIGS. 2A and 2B.
Figure 4B:
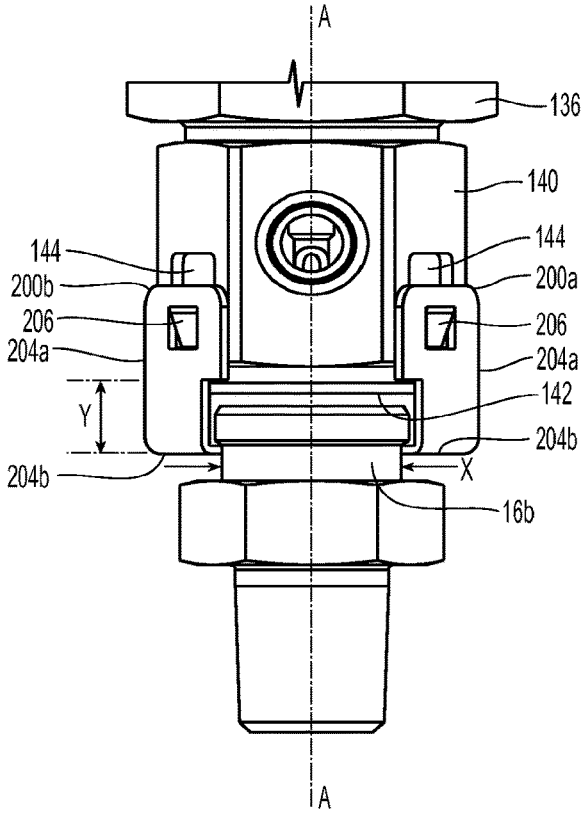
FIG. 4B is a plan view of the cartridge and the actuator assembly of FIG. 4A.

Referring now to FIGS. 4A and 4B, shown is a distal end 142 of an actuator assembly about which depends a preferred control element 200. More particularly shown is the second housing portion 110*b* of the actuator assembly 100 from which depends the control element 200. In FIG. 4A a connection end of an illustrative pressurized cartridge 16 is shown as having a preferably externally threaded male end 16*a* with a grooved or narrowed neck portion 16*b*. Generally, the control element 200 defines a guide path 202 for inserting the cartridge 16 in the receptacle 138 formed in the distal portion 114 of the housing 110. The preferred guide path 202 has a first portion 202*a* extending along a guide axis B-B transversely to the actuator axis A-A. The preferred guide path 202 also preferably includes a second portion 202*b* that extends along the actuator axis A-A for entry into the receptacle 138 of the distal portion 114 of the housing 110. The preferred guide path 202 is configured to control the manner in which a cartridge 16 is coupled with the actuator assembly 100 by providing a limited path that will permit the two components to be coupled or decoupled if the internal puncturing assembly is in the retracted position.

In one preferred embodiment of the control element 200, the control element preferably includes a bracket having a first bracket member 200*a* and at least a second bracket member 200*b* disposed about the housing 110 and its receptacle 138. Each of the first and second bracket members 200*a*, 200*b* have a first bracket portion 204*a* engaged with the peripheral outer surface 140 of the housing. Each of the bracket members 200*a*, 200*b* also preferably includes a second bracket portion 204*b* angled with respect to the first bracket portion 204*a* to extend toward and terminate about the actuator axis A-A to define a width X of the first transverse portion of the guide path 202*a* to limit receipt therein to the grooved coupling portion 16*b* of the suppressant cartridge 16.

Figure 4C:
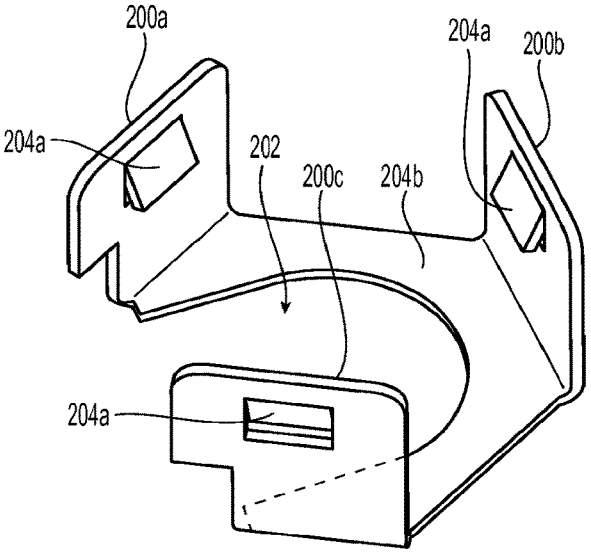
FIG. 4C is a perspective view of a preferred bracket for use with the actuator assembly of FIGS. 2A and 2B.

Shown in FIG. 4C is a preferred embodiment of the bracket 200 to engage the preferred embodiment of the housing 110 where the outer surface 140 of the distal portion 114 defines a preferred hexagonal periphery. The bracket 200 preferably includes first and second bracket members 200*a*, 200*b* and a third bracket member 200*c* preferably disposed equiangularly relative to one another to respectively engage three equiangularly disposed facets of the preferred hexagonal periphery of the housing 110. The first bracket portions 204*a* of each of the three bracket members 200*a*, 200*b* are preferably joined by a unitary second bracket portion 204*b* which is to be disposed perpendicular to the actuator axis A-A when coupled to the housing 110. The second bracket portion 204*b* preferably defines an open ended slot to define the transverse portion of the guide path 202*a* for receipt of the grooved coupling portion 16*b* of the suppressant cartridge 16.

Referring to FIGS. 2A, 2B, 4A and 4B, the bracket 200 preferably has an uncoupled configuration in which the second bracket portion is axially spaced from the distal end surface 142 of the actuator assembly 100 to define a clearance or height Y of the guide path extending in the direction of the second portion of the guide path 202*b* to preferably limit receipt therein to the externally threaded portion of the suppressant cartridge. Once the cartridge has been transversely slid into axial alignment below the receptacle 138, the cartridge 16 can be inserted and threaded into the receptacle 138 in the direction of the second guide path portion 202*b*. Threading the cartridge 16 into the receptacle 138 preferably supports and translates the bracket 200 in the proximal direction so as to reduce the height Y of the guide path 202 and bring the second portion 204*b* of the bracket into engagement or near engagement with the distal end surface 142 of the actuator assembly 100. The second bracket portion 204*b* more preferably defines a preferred axial thickness to act as a gauge between the distal end surface 142 of the actuator housing 110 and the cartridge 16, as seen for example, in FIG. 2A, to locate the cartridge 16 at a desired depth within the receptacle 138 of the housing 110 and to locate the ruptured disc 18 of the cartridge 16 at a desired axial distance from the puncturing assembly 126. To facilitate the preferred sliding engagement of the bracket 200 with the housing 110, each of the preferred bracket members 200*a*, 200*b*, 200*c* include projection 206 which preferably extends along and oblique to first portion 204*a* of the bracket member. The bracket projections 206 each preferably engage a respective pocket 144 or other indentation formed along the outer surface 140 of the housing 110 to retain the bracket on the housing 110. The pocket 144 is formed to a preferred axial length to permit the bracket to translate relative to the housing 110.

Figure 5A:
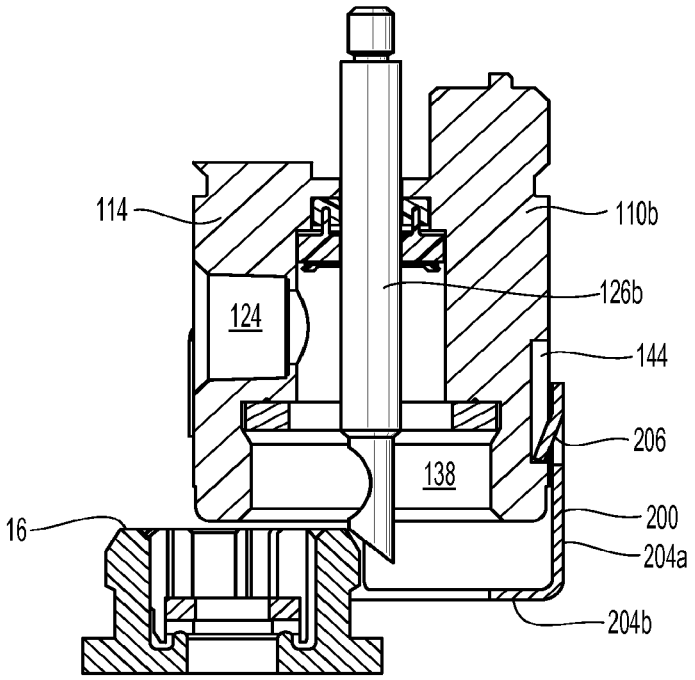
FIG. 5A is a partial cross-sectional view of a cartridge and the actuating device of FIGS. 2A and 2B.
Figure 5B:
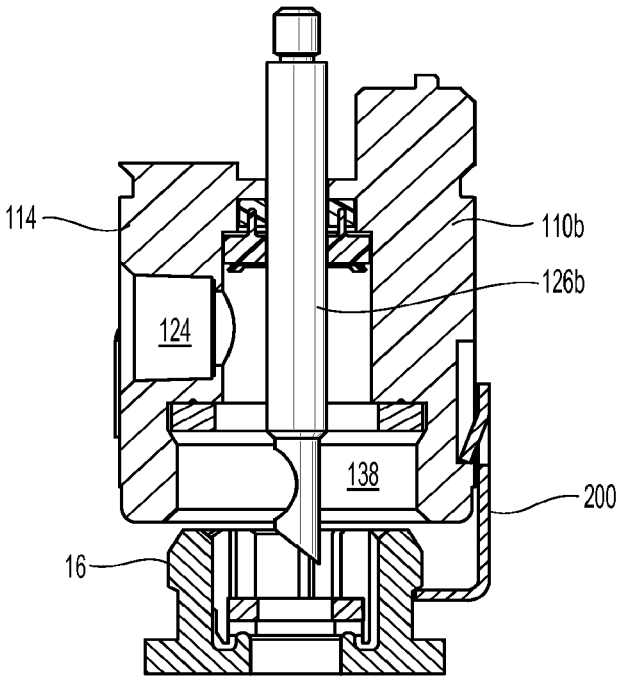
FIG. 5B is another partial cross-sectional view of a cartridge and the actuating device of FIGS. 2A and 2B.

Again, the preferred guide path 202 only permits the cartridge 16 to be inserted into the receptacle if the puncturing assembly 126 is in its retracted position. Referring now to FIG. 5A, the puncturing assembly 126 and its puncturing pin 126*b* are shown in their preferred actuated or displaced position extending below the distal end 142 of the housing 110. The displaced puncturing pin 126*b* is disposed within the guide path 202 and therefore prevents insertion and alignment of a new cartridge 16 with the receptacle 138. Accordingly, the preferred control element 200 limits the coupling of a cartridge 16 and the actuator assembly 100 by defining the preferred path 202 to intersect the displaced puncturing assembly. The preferred guide path 202 also prevents disassembly or disengagement of the cartridge 16 and the actuator assembly 100 when the puncturing pin 126*b* is in its displaced position. Referring to FIG. 5B, the unthreaded cartridge 16 is prevented from being completely removed from the actuator assembly 100 because the displaced puncturing pin 126*b* and the bracket 200 prevent complete retraction of the cartridge 16 in the transverse direction away from the housing 110.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. An actuator assembly configured for rupturing a seal of a cartridge of gas, the assembly comprising:

a housing having a proximal end and a distal end with a passageway extending axially from the proximal end to the distal end along an actuator axis, the housing including at least one inlet port in communication with the passageway for coupling to a pressurized gas source;

an electrically operated protracting actuation device having an electrical connector and a rod member; and a puncturing assembly including a head with a puncturing pin extending axially from the head, the puncturing assembly having an actuated position and a retracted position within the passageway with the head biased in a proximal direction to the retracted position, wherein the puncturing assembly is configured for translation from the retracted position to the actuated position (a) upon electrical operation of the protracting actuation device that causes the rod member to press against the puncturing assembly, and wherein the puncturing assembly is also configured for translation from the retracted position to the actuated position (b) upon delivery of pressurized gas from the pressurized gas source to the at least one inlet port acting on the head.

2. The assembly of claim 1, wherein the passageway defines a first chamber and a second chamber with the second chamber disposed distally of the first chamber, with the first and second chambers centered along the actuator axis.

3. The assembly of claim 2, wherein the at least one inlet port is formed between the first and second chambers.

4. The assembly of claim 2, wherein the electrical connector is disposed in the first chamber and the rod member is disposed in the second chamber.

5. The assembly of claim 2, wherein the first chamber is sealed from the second chamber and the at least one inlet port.

6. The assembly of claim 2, wherein the head is positioned in the second chamber and biased in the proximal direction to the retracted position.

7. The assembly of claim 2, wherein the protracting actuation device is disposed within the housing such that the electrical connector is disposed in the first chamber and the rod member is disposed in the second chamber.

8. The assembly of claim 1, wherein the at least one inlet port includes two inlet ports diametrically opposed about the passageway.

9. The assembly of claim 8, wherein the two inlet ports provide for linearly interconnecting the actuator assembly to a plurality of actuator assemblies such that each of the actuator assemblies can be actuated by gas delivered from the pressurized gas source.

10. The actuator assembly of claim 1, wherein the protracting actuation device includes a sheath slidably coupling the rod member to the electrical connector.

11. The actuator system of claim 1, wherein the housing is configured to be coupled to the cartridge such that the puncturing assembly contacts the cartridge in the actuated position.

12. An actuator system configured for rupturing a seal of a cartridge of gas, the system comprising:

a pressurized gas source; and an actuator assembly, comprising:

a housing having a proximal end and a distal end with a passageway extending axially from the proximal end to the distal end along an actuator axis, the housing including at least one inlet port in communication with the passageway and coupled to the pressurized gas source;

an electrically operated protracting actuation device having an electrical connector and a rod member movably coupled to the housing; and a puncturing assembly including a head with a puncturing pin extending axially from the head, the puncturing assembly having an actuated position and a retracted position within the passageway with the head in a proximal direction to the retracted position, wherein the puncturing assembly is configured to translate from the retracted position to the actuated position (a) upon electrical operation of the protracting actuation device, and wherein the puncturing assembly is also configured to translate from the retracted position to the actuated position (b) upon delivery of pressurized gas from the pressurized gas source to the at least one inlet port acting on the head.

13. The system of claim 12, wherein the passageway defines a first chamber and a second chamber with the second chamber disposed distally of the first chamber, with the first and second chambers centered along the actuator axis.

14. The system of claim 13, wherein the at least one inlet port is formed between the first and second chambers.

15. The system of claim 13, wherein the head is positioned in the second chamber and biased in the proximal direction to the retracted position.

16. The system of claim 13, wherein the protracting actuation device is disposed within the housing such that the electrical connector is disposed in the first chamber and the rod member is disposed in the second chamber.

17. The system of claim 12, wherein the at least one inlet port includes two inlet ports diametrically opposed about the passageway.

18. The actuator system of claim 12, wherein the protracting actuation device includes a sheath slidably coupling the rod member to the electrical connector.

19. A vehicle fire suppression system comprising:

an electrical actuation signal source;

a plurality of pressurized gas cartridges;

a plurality of storage tanks of firefighting suppressant;

a plurality of interconnected actuator assemblies, each actuator assembly being coupled and connected to (a) the electrical actuation signal source, (b) one of the plurality of pressurized gas cartridges, and (c) one of the plurality of storage tanks, each actuator assembly comprising:

a housing having a proximal end and a distal end with a passageway extending axially from the proximal end to the distal end along an actuator axis, the housing including at least one inlet port in communication with the passageway and coupled to a pressurized gas source;

an electrically operated protracting actuation device coupled to the electrical actuation signal source and having an electrical connector and a rod member; and a puncturing assembly including a head with a puncturing pin extending axially from the head, the puncturing assembly having an actuated position and a retracted position within the passageway with the head biased in a proximal direction to the retracted position, wherein the puncturing assembly is configured to translate from the retracted position to the actuated position (a) upon electrical operation of the protracting actuation device that causes the rod member to press against the puncturing assembly, and wherein the puncturing assembly is also configured to translate from the retracted position to the actuated position (b) upon delivery of pressurized gas from the pressurized gas source to the at least one inlet port acting on the head.

20. The vehicle fire suppression system of claim 19, wherein each housing is coupled to the corresponding one of the pressurized gas cartridges such that each puncturing assembly contacts the corresponding one of the pressurized gas cartridges in the actuated position.

* * * * *